US005642526A

United States Patent [19]

Thompson

[11] Patent Number: 5,642,526

[45] Date of Patent: Jul. 1, 1997

[54] CONVERTIBLE GARMENT HAVING A VENTILATION OPENING AND A STORAGE POUCH

[76] Inventor: Robert E. Thompson, Rte. 3, Box 358, Cuthbert, Ga. 31740

[21] Appl. No.: 661,106

[22] Filed: Jun. 10, 1996

[51] Int. Cl.[6] ..... A41D 15/00; A41D 1/00

[52] U.S. Cl. ..... 2/79; 2/94; 2/69; 2/DIG. 1

[58] Field of Search ..... 2/79, 69, 94, 85, 2/93, 108, DIG. 1

[56] References Cited

U.S. PATENT DOCUMENTS

| | | | |
|---|---|---|---|
| 2,465,286 | 3/1949 | Silversteen | 2/DIG. 1 |
| 3,086,215 | 4/1963 | Di Paola | 2/DIG. 1 |
| 3,153,793 | 10/1964 | Lepore | 2/DIG. 1 |
| 4,023,223 | 5/1977 | Anderson et al. | 2/79 |
| 4,667,344 | 5/1987 | Cooper, III | 2/79 |

*Primary Examiner*—C. D. Crowder
*Assistant Examiner*—Shirra L. Jenkins
*Attorney, Agent, or Firm*—Watson Cole Stevens Davis, P.L.L.C.

[57] ABSTRACT

The back part of the torso of the garment has a ventilation opening therein which can be selectively opened or closed by a slide fastener. A storage pouch is secured to the inside of the back part in surrounding relationship to the ventilation opening and provides a volume for receiving the garment when the pouch is pulled rearwardly of the garment through the ventilation opening. The storage pouch is formed of a sheet of material such as open mesh to provide free flow of air therethrough so that it will provide ventilation for the garment when it is worn as well as when it is in stored position. A flap is disposed adjacent the ventilation opening and extends laterally away from the garment when the ventilation opening is open to prevent the flap from closing off the opening. Air vents are provided under the arms. The open ends of the arms and legs can be closed by hook and loop type closure means such as VELCRO.

16 Claims, 3 Drawing Sheets

10
12
16
16'
18
18'
19
20
20'
22
22'
24
26
28
30
32
34
36
40
60
78
80
112
114
116
134
136

CONVERTIBLE GARMENT HAVING A VENTILATION OPENING AND A STORAGE POUCH

BACKGROUND OF THE INVENTION

The present invention relates to a convertible garment such as a jumpsuit having camouflage markings on the outer surface thereof which is used by hunters in the field. The garment is designed to serve as a full-sized jumpsuit when worn and additionally provides an arrangement whereby the garment can be stored within a built-in storage pouch when not in use. The garment may be folded into a very small bundle and stuffed into the storage pouch in a very compact manner so that the garment when in stored position occupies a minimum of space and can be used, for example, as a pillow and to store small hunting accessories.

Garments of this type are used at different times of the year, and accordingly, it is desirable to provide a garment that can be used in very hot weather as well as at subzero temperatures. One of the requirements of a garment to be used under such circumstances is to provide adequate ventilation of the garment during hot weather, and further providing means to keep heat inside the garment during cold weather.

It is therefore a principal objective of the invention to provide a garment which provides adequate ventilation not only when the garment is worn, but also when the garment is in stored position. In order to provide proper ventilation of the garment during hot weather, flow of air through the garment should be maximized so as to provide the desired cooling of the person wearing the garment.

Prior art garments of this type have employed constructions which are rather complex and expensive to manufacture. It is therefore another important objective of the invention to provide a construction which is simple and economical to manufacture.

SUMMARY OF THE INVENTION

The invention garment incorporates a ventilation opening in the back thereof, and a closure means such as a slide fastener is provided for selectively opening and closing the ventilation opening. A storage pouch is disposed within the garment adjacent the ventilation opening and has opening means formed therethrough to permit free flow of air through the storage pouch at all times. In a typical construction, the storage pouch may comprise a sheet of open mesh material. When the garment is worn on a hot day and the ventilation opening is open, the pouch permits maximum circulation of air through the ventilation opening, thence through the opening means in the storage pouch and into the interior of the garment. On the other hand, when the garment is stored within the storage pouch, the opening means in the storage pouch allows air to circulate to the folded garment within the storage pouch, which is highly desirable.

A flap is provided to overlie the closure means for the ventilation opening when the ventilation opening is closed. The construction of the flap is such that when the ventilation opening is open, the flap will extend laterally away from the garment to prevent the flap from closing off the ventilation opening.

The garment is provided with additional air vents at the armpit portions of the garment between the torso portion and sleeve portions of the garment. Air vent closure means is provided for selectively opening and closing each of the air vents so that ventilation may be obtained therethrough in hot weather, yet the air vents may be closed during cold weather.

The open ends of the sleeve portions are provided with sleeve closure means so that the open ends can be selectively opened in warm weather and closed in cold weather for added comfort for the person wearing the garment.

The open ends of the leg portions of the garment are also provided with leg closure means so that the open ends of the leg portions can be selectively opened in warm weather and closed in cold weather as desired.

The garment also includes an additional layer of material secured between the back of the garment and the storage pouch which has an inwardly facing abrasion resistant surface thereon. When the garment is in stored position, this abrasion resistant surface faces outwardly of the garment to minimize abrasion damage to the stored garment.

The construction of the present invention is relatively simple so that the finished product can be manufactured at minimum expense.

DESCRIPTION OF THE PREFERRED EMBODIMENT

Figures 1, 2:
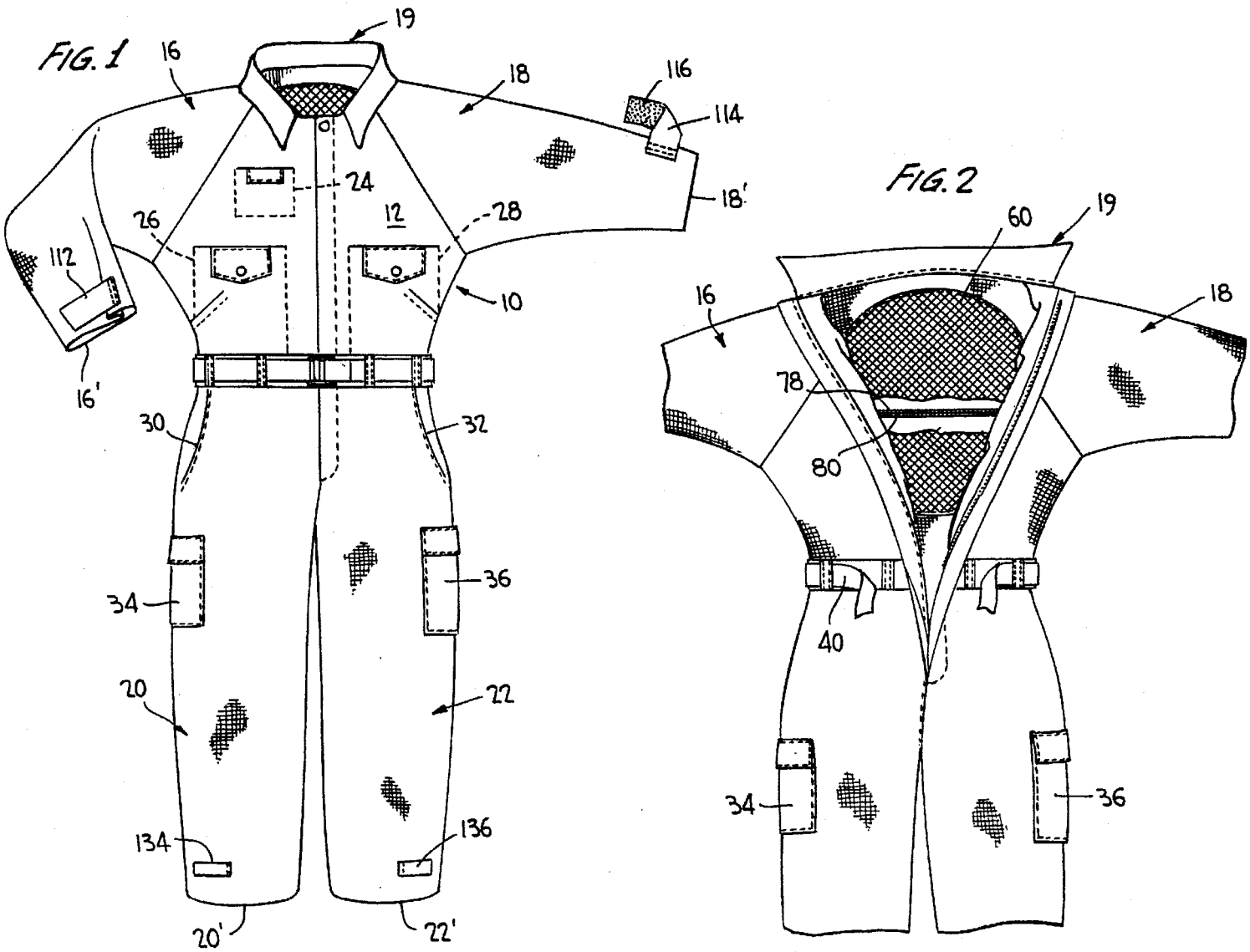
FIG. 1 is a front view of a garment according to the invention.
FIG. 2 is a view of a portion of the garment illustrated in FIG. 1 with the front of the garment folded back to show the construction within the garment.

Referring now to the drawings wherein like reference characters designate corresponding parts throughout the several views, there is shown in FIGS. 1–4 a garment formed of a woven fabric such as brushed twill having an outer surface which is abrasion resistant. The garment includes a torso portion 10 having a front part 12 and a back part 14. A pair of raglan sleeve portions 16 and 18 are joined to the torso portion adjacent a collar 19, and a pair of leg portions 20 and 22 are also joined to the torso portion. Three chest pockets 24, 26 and 28 are provided on the torso portion. Two handwarmers 30 and 32 are provided in the leg portions. Two cargo pockets 34 and 36 as well as a hip pocket 38 are also provided on the leg portions. An adjustable belt 40 also provides for a close fit around the waist of a person wearing the garment.

Figure 5:
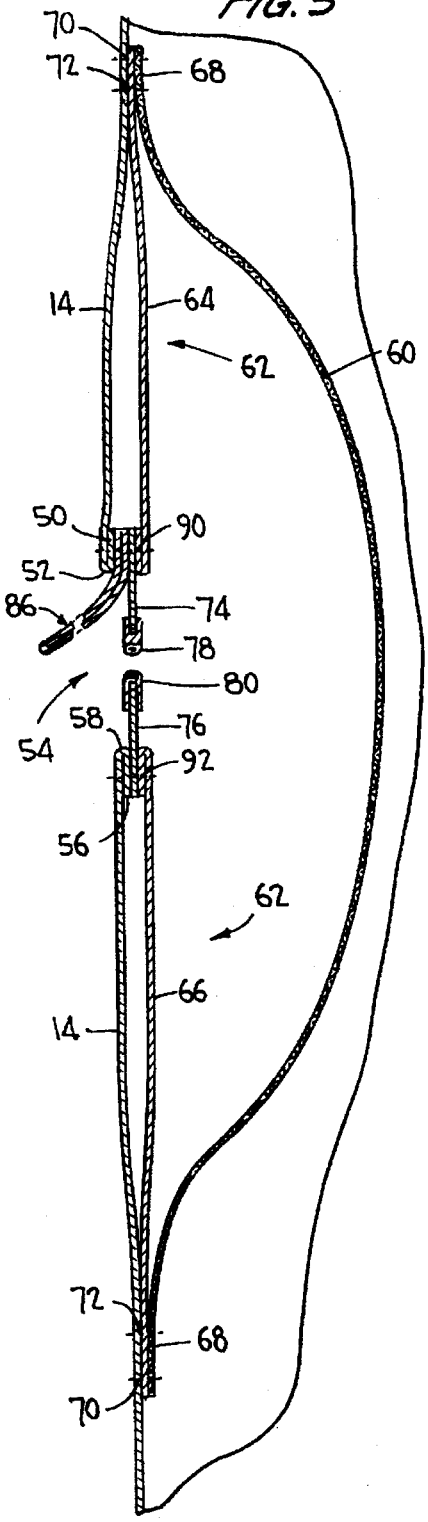
FIG. 5 is an enlarged sectional view taken on like 5—5 of FIG. 3 looking in the direction of the arrows.

Referring to FIG. 5, the back part 14 is slit horizontally with lower edge of the upper part of the back part being folded upon itself at 50 to define an upper edge 52 of a horizontal ventilation opening 54 in the back portion of the garment. The upper edge of the lower part of the back part is folded upon itself at 56 to define a lower edge 58 of the ventilation opening. The outwardly facing surface of the garment is abrasion resistant.

A storage pouch 60 formed of nylon or other suitable plastic substance comprises a thin sheet of fishnet material having a large amount of open space formed therethrough so that air may freely circulate through the pouch. An additional layer of material 62 is disposed between the back part 14 and the storage pouch 60. This additional layer of material may be formed of the same material as the garment, but layer of material 62 is reversed so that the inwardly facing surface thereof is abrasion resistant whereby when the storage pouch 60 is pulled through the ventilation opening and the garment folded thereinto, the inner face of layer 62 as seen in FIG. 5 will be facing outwardly to resist abrasion damage.

Layer of material 62 may be formed of a single piece of material or two separate pieces of material, and in any event will include two substantially semi-circular portions 64 and 66 which define a substantially circular outer periphery. The storage pouch also has a substantially circular outer periphery having a diameter which is larger than that of layer of material 62 so that the storage pouch will define a volume as seen in FIG. 5 therewithin. This volume is sufficient to store the garment when the storage pouch is pulled through the ventilation opening.

In manufacturing the device, the outer peripheries of storage pouch 60 and layer 62 are first serged to one another in a conventional manner by stitching 68. Since the outer diameter of the storage pouch is greater than that of layer 62, the extra material along the periphery of the pouch will be gathered during the serging operation. Then the outer peripheries of pouch 60 and layer 62 are secured to the back part 14 by two lines of stitching 70 and 72. When so secured in position, the storage pouch is disposed in surrounding relationship to the ventilation opening 54.

A closure means for selectively opening and closing the ventilation opening comprises a conventional reversible slide fastener including a single pull tab. The slide fastener includes a pair of strips of material 74 and 76 having the usual metal gripping elements 78 and 80 thereon, the pull tab being indicated by reference numeral 82 on FIG. 7 of the drawings.

Referring again to FIG. 5, a flap 86 comprises a layer of material doubled upon itself and supported adjacent the upper edge 52 of the ventilation opening. The flap is adapted to cover the slide fastener when the ventilation opening is closed, but in open position as shown in FIG. 5, the doubled construction of the flap is such that it will extend laterally away from the garment when the ventilation opening is open to prevent the flap from closing off the ventilation opening. A line of stitching 90 secures the upper part of the back part 14, flap 86, strip of material 74 and the lower folded edge of portion 64 of the layer 62 together. A line of stitching 92 secures the lower part of back part 14, strip of material 76 and the upper folded edge of portion 66 of the layer 62 together.

Figure 6:
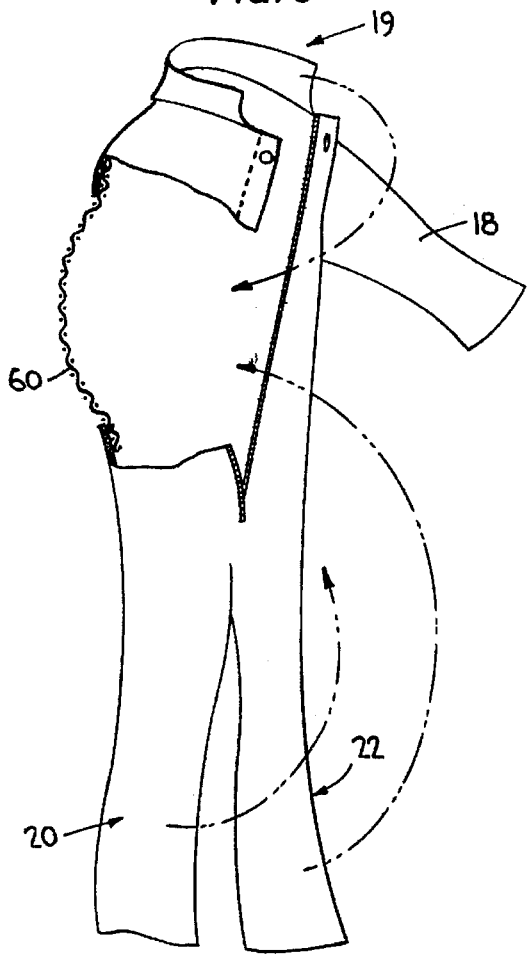
FIG. 6 is a somewhat schematic view showing the manner in which the storage pouch is pulled through the ventilation opening and the garment is folded into the pouch for storage.
Figure 7:
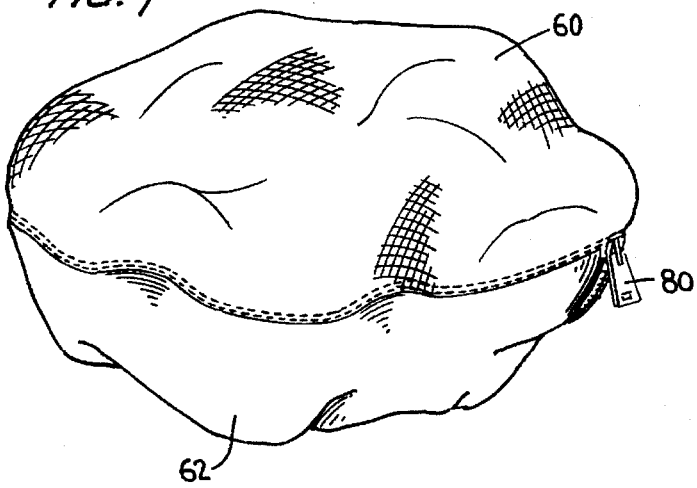
FIG. 7 shows the garment in its stored position.

FIG. 6 illustrates schematically how the garment is disposed in stored position. The pouch 60 is first pulled through the ventilation opening, whereupon the garment is folded and stuffed into the the pouch as indicated by the arrows. FIG. 7 shows the garment in stored position wherein the device assumes a generally round configuration with the pouch 60 facing upwardly, and the layer of material 62 facing downwardly with the abrasion resistant surface thereof facing outwardly.

Figure 4:
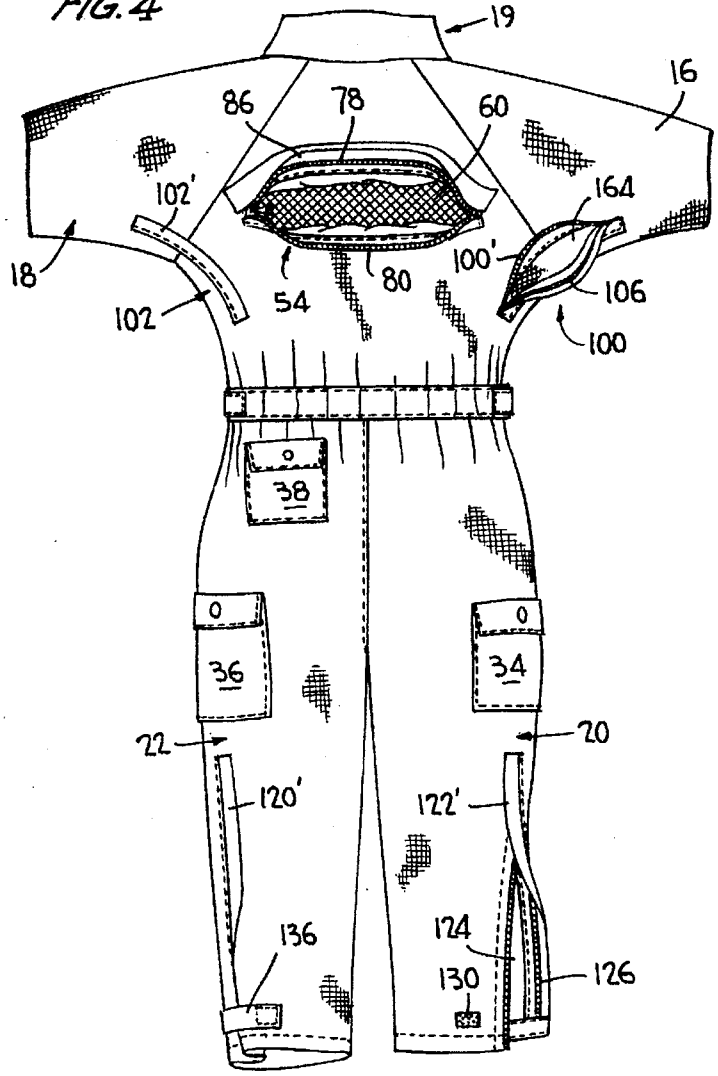
FIG. 4 is a view similar to FIG. 3 showing the ventilation opening and one of the air vents in open position.
Figure 3:
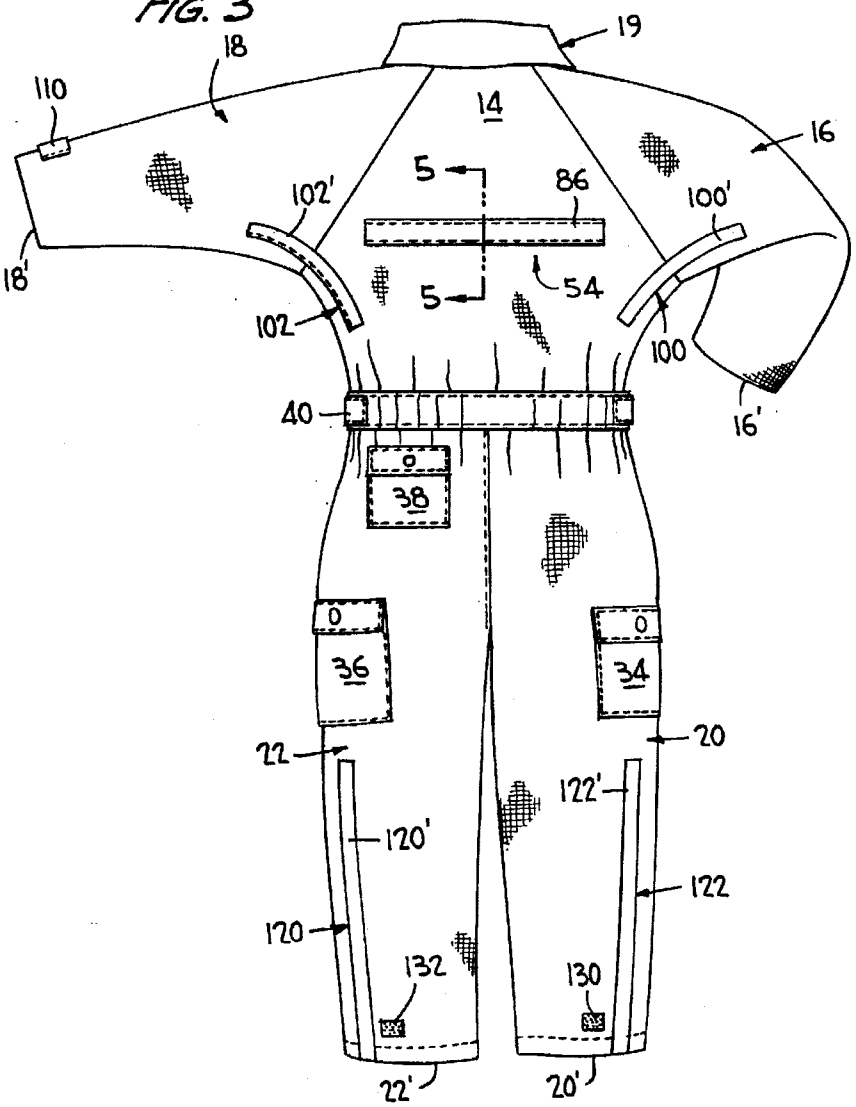
FIG. 3 is a back view of the garment.

Referring to FIGS. 3 and 4, each of the sleeve portions 16 and 18 has an upper part adjacent the torso portion and collar of the garment, these upper parts of the sleeve portions having air vents indicated generally at 100 and 102 formed therethrough. The air vents are formed by providing slits in the upper parts of the sleeve portions and the adjacent torso portions so as to be adjacent the arm pits of a person wearing the garment. These slits can be selectively opened or closed by air vent closure means in the form of conventional slide fasteners the metal gripping elements 104 and 106 of which can be seen at the right side of FIG. 4. The flap 100' has been folded back to illustrate these gripping elements. The flaps 100' and 102' as shown elsewhere in FIGS. 3 and 4 are shown with the air vents in closed position and with the flaps in overlying relationship to the closure means.

Referring to FIGS. 1 and 3, the sleeve portions include open ends 16' and 18' and sleeve closure means is provided for selectively opening and closing the open end portions of the sleeves. The sleeve closure means associated with the open end 16' of sleeve portion 16 comprises a strip of hooks and loops 110 stitched thereto, and a strap 112 has one end thereof stitched to sleeve portion 16. Strap 112 has a strip of loops and hooks stitched to the opposite end of the strap for engagement with the piece of hooks and loops 110. It is apparent that the sleeve closure means may be used for allowing the open end of the sleeve portion to remain open in warm weather and to close the open end of the sleeve portion during cold weather as desired.

The sleeve closure means associated with the open end 18' of sleeve portion 18 is substantially identical and includes a strap 114 having one end thereof stitched to sleeve portion 18. A strip of hooks and loops 116 is stitched to the opposite end of strap 114 and is adapted to cooperate with a strip of loops and hooks (not shown) stitched to sleeve portion 18.

Referring to FIGS. 3 and 4, the lower sides of the leg portions have slits indicated generally by reference numerals 120 and 122 extending upwardly therein to allow the leg portions to expand so that boots can pass easily through the legs. Leg closure means is provided for each slit in the form of conventional slide fastener means. As seen in the right side of FIG. 4, the metal gripping portions 124 and 126 are illustrated. Flaps 120' and 122' are adapted to lie over the slide fasteners when the slits are closed.

The lower end portions 20' and 22' of leg portions 20 and 22 are open, and leg closure means is provided for selectively opening and closing the open end portions of the leg portions. The leg closure means comprises a pair of strips of hooks and loops 130 and 132 which are stitched to leg portions 20 and 22 respectively. A pair of straps 134 and 136 have one end thereof stitched respectively to leg portions 20 and 22, strips of loops and hooks (not shown) being stitched to the opposite ends of the straps for cooperation with the strips 130 and 132. It is apparent that the leg closure means may be used for allowing the open ends of the leg portions to remain open in warm weather and to close the open ends of the leg portions during cold weather.

The hooks and loops of 110 and 112, of 116 and 114, of 130 and 134, and of 132 and 136, when respectively interengaged, may comprise known closure means such as VELCRO.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A convertible garment comprising a torso portion having a front part and a back part, a pair of sleeve portions extending from said torso portion, a pair of leg portions extending from said torso portion, said back part having a ventilation opening formed therethrough, closure means for selectively opening and closing said ventilation opening, a storage pouch disposed within said garment, said storage pouch when pulled through said ventilation opening defining a volume therewithin for storing the garment, said storage pouch having opening means formed therethrough to permit free flow of air through the storage pouch to provide ventilation for the garment both when the garment is worn and said ventilation opening is open and when the garment is stored within said storage pouch and the ventilation opening is closed.

2. A garment as defined in claim 1 wherein said ventilation opening is disposed substantially horizontally and is defined between an upper edge and a lower edge formed on said back part, and a flap supported adjacent said upper edge and extending downwardly therefrom, said flap extending laterally away from the garment when the ventilation opening is open to prevent the flap from closing off the ventilation opening.

3. A garment as defined in claim 1 wherein said garment includes an outwardly facing surface which is abrasion resistant, and including an additional layer of material disposed between said back part and said storage pouch, said additional layer of material having an inwardly facing surface which is abrasion resistant.

4. A garment as defined in claim 3 wherein said additional layer of material comprises a pair of generally semi-circular portions which are secured to said back part and said storage pouch.

5. A garment as defined in claim 1 wherein said closure means comprises a slide fastener.

6. A garment as defined in claim 1 wherein each of said sleeve portions includes an upper part adjacent said torso portion, said upper part of each sleeve portion having an air vent formed therethrough, air vent closure means for selectively opening and closing each of said air vents, and flap means adapted to cover each air vent closure means when the associated air vent is closed.

7. A garment as defined in claim 6 wherein each of said sleeve portions has an open end portion, and sleeve closure means for selectively opening and closing the open end portions of each of said sleeves.

8. A garment as defined in claim 6 wherein each of said leg portions has an open end portion, and leg closure means for selectively opening and closing the open end portions of each of said legs.

9. A convertible garment comprising a torso portion having a front part and a back part, a pair of sleeve portions extending from said torso portion, a pair of leg portions extending from said torso portion, said back part having a ventilation opening formed therethrough, closure means for selectively opening and closing said ventilation opening, a storage pouch disposed within said garment and having an outer peripheral portion which is secured to said back part in surrounding relationship to said opening, said storage pouch pouch when pulled through said ventilation opening defining a volume therewithin for storing the garment, said storage pouch being formed of a material having a large amount of open space formed therethrough to maximize flow of air therethrough while providing adequate support for storing the garment, said open space providing ventilation for the garment both when the garment is worn and said ventilation opening is open and when the garment is stored within said storage pouch and the ventilation opening is closed.

10. A garment as defined in claim 9 wherein said ventilation opening is disposed substantially horizontally and is defined between an upper edge and a lower edge formed on said back part, and a flap supported adjacent said upper edge and extending downwardly therefrom, said flap being doubled upon itself to cause it to extend laterally away from the garment when the ventilation opening is open to prevent the flap from closing off the ventilation opening.

11. A garment as defined in claim 9 wherein said storage pouch is of open mesh construction.

12. A garment as defined in claim 9 including an additional layer of material disposed between said back part and said storage pouch, said additional layer being formed of two substantially semi-circular portions of material defining an outer substantially circular outer periphery, said pouch defining a substantially circular outer periphery which is larger than that defined by said two semi-circular portions of material to provide sufficient volume within said storage pouch when pulled through said ventilation opening to store the garment.

13. A garment as defined in claim 9 wherein said closure means comprises a slide fastener.

14. A garment as defined in claim 9 wherein each of said sleeve portions includes an upper part adjacent said torso portion, said upper part of each sleeve portion having an air vent formed therethrough, air vent closure means for selectively opening and closing each of said air vents, and flap means adapted to cover each air vent closure means when the associated air vent is closed.

15. A garment as defined in claim 14 wherein each of said sleeve portions has an open end portion, and sleeve closure means for selectively opening and closing the open end portions of each of said sleeves.

16. A garment as defined in claim 9 wherein each of said leg portions has an open end portion, and leg closure means for selectively opening and closing the open end portions of each of said legs.

* * * * *